United States Patent [19]

Orzechowski et al.

[11] 3,964,696

[45] June 22, 1976

[54] METHOD OF CONTROLLING THE SPIN RATE OF TUBE LAUNCHED ROCKETS

[75] Inventors: Casimir T. Orzechowski, Kensington; Nat Seiden, Brandywine; Anthony Mycka, Jr., Waldorf, all of Md.

[73] Assignee: The United States of America as represented by the Secretary of the Navy, Washington, D.C.

[22] Filed: Oct. 30, 1974

[21] Appl. No.: 519,371

[52] U.S. Cl. ..... 244/3.23; 244/3.29

[51] Int. Cl.[2] ..... F42B 13/32

[58] Field of Search ..... 244/3.23, 3.29

[56] References Cited

UNITED STATES PATENTS

| | | | |
|---|---|---|---|
| 2,145,508 | 1/1939 | Denoix | 244/3.23 |
| 3,177,809 | 4/1965 | Russell-French | 244/3.29 |
| 3,333,790 | 8/1967 | Durand, Jr. | 244/3.23 |

*Primary Examiner*—Verlin R. Pendegrass
*Attorney, Agent, or Firm*—R. Sciascia; R. Beers; S. Sheinbein

[57] ABSTRACT

The spin rate of a rocket missile is controlled by bevelling the inside of the leading edge of the missile fins. Altering the bevel angle controls the rate of spin. The spin rate is also controlled by sweeping back the leading edges of the fins.

4 Claims, 4 Drawing Figures

METHOD OF CONTROLLING THE SPIN RATE OF TUBE LAUNCHED ROCKETS

STATEMENT OF GOVERNMENT INTEREST

The invention described herein may be manufactured and used by or for the Government of the United States of America for governmental purposes without the payment of any royal-ties thereon or therefor.

BACKGROUND OF THE INVENTION

This invention relates to rocket missiles and especially to means for controlling the spin rate of such missiles.

Ballistic dispersion, i.e., the amount of spread in the striking points of missiles aimed at a given target from the same aiming point, is a measure of the accuracy of a given type of missile. It is obvious, of course, that absolute accuracy is the desired object of weapons makers and the less dispersion a missile has, the more accurate it is.

One way of reducing dispersion appreciably is by spinning the rocket during the thrusting phase. Additional improvements can be made by controlling the spin rate of the rocket throughout its flight phase. When the spin rate is close to the natural pitching frequency of the missile, the missile flies with a coning motion which increases drag, and decreases range and accuracy.

SUMMARY OF THE INVENTION

The present invention controls the spin rate of a missile which has fins by bevelling the inside of the leading edges of the fins and controlling the bevel angle. A further way by which the invention controls the spin rate is by sweeping back the leading edges of the fins.

An object of this invention is to control the spin rate of a flying missile.

A further object is to improve the ballistic dispersion and, therefore, accuracy of missiles.

Another object is to permit optimization of rocket structure and reduce rocket weight and manufacturing costs.

Other objects, advantages and novel features of the present invention will become apparent from the following detailed description of the invention when considered in conjunction with the accompanying drawing.

DETAILED DESCRIPTION OF THE INVENTION

Figure 1:
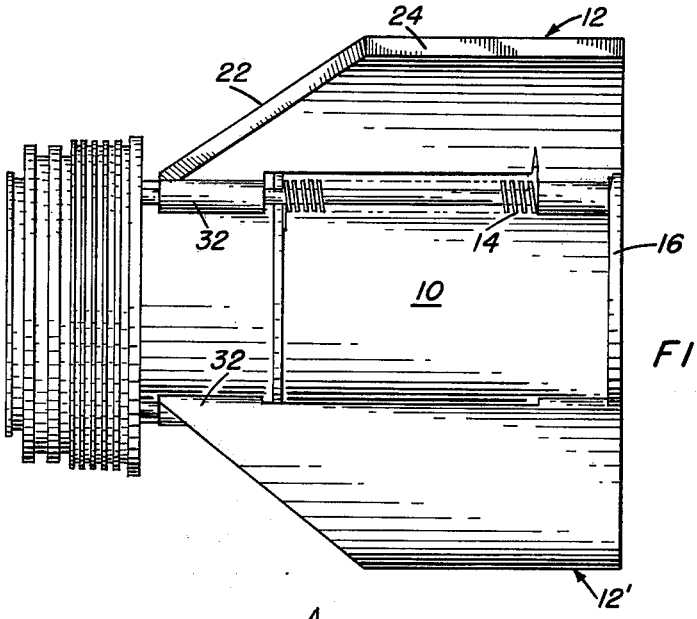
FIG. 1 is a schematic side view of the nozzle of a rocket missile embodying the present invention.

FIG. 1 is an illustration of a rocket nozzle 10, the rocket missile component through which the hot gases exit. The nozzle 10 carries four wrap-around fins 12 which are erected into flying position by a biasing means 14 when the fins clear the launcher tube (not shown).

Figure 2:
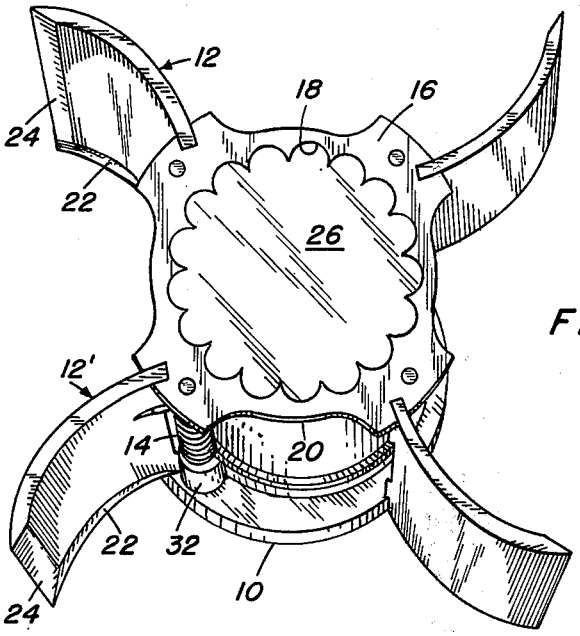
FIG. 2 is a schematic end view of the nozzle shown in FIG. 1.

FIG. 2 shows the nozzle and fins as seen from the rear of the nozzle. The end plate, or bourrelet flange, 16 of the nozzle has a bore 26 which is formed with flutes 18 for the purpose of spinning the rocket when the hot gases exit. The fins 12 have a bevel 22 on the inside of the fin along its leading edge 28. (The term "inside" refers to the concave surface of the fin.)

The fins also have a bevel 24 along the top edge 30 of the fin but the top bevels are not part of the invention. They simply are placed on the fins to permit folding of the fins without interference.

The customary way to build a fin is to make it rectangular in shape when it is viewed from the side. FIGS. 1 and 3A show that, in this invention, the leading edge 28 of each fin is swept back along its entire length by an angle $\theta$, a procedure which also controls the spin rate of a missile. The sweep-back angle $\theta$ should preferably be about 45° for optimum control of spin rate without too great a loss of stabilization.

The bevel of the leading edge, as said before, also controls the spin rate of the missile. The greater the bevel angle is, the greater will be the spin force exerted on the fins (rolling moment) and therefore the greater will be the spin rate. A typical angle for the bevel might be 22°, although bevel angles might range roughly between 5 and 45°.

Figure 3B:
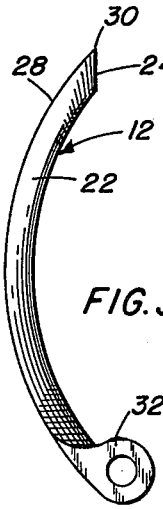
FIG. 3B is a schematic front view of the fin shown in FIG. 3A.
Figure 3A:
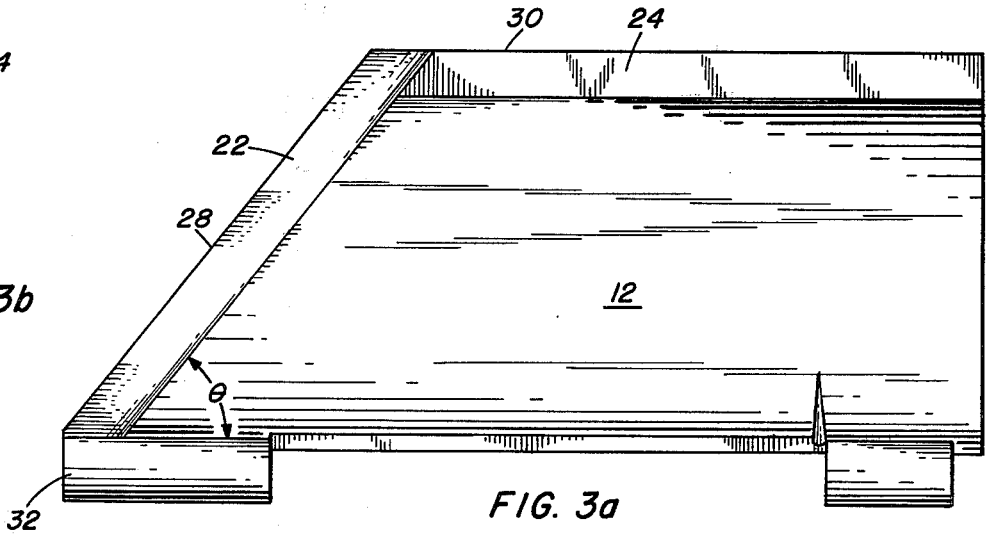
FIG. 3A is a schematic side view of a fin made in accordance with this invention.

FIG. 3B shows a front view of the fin shown in FIG. 3A, indicating the curvature of a typical fin. The curve of the fin as shown in FIGS. 2 and 3B will be designated hereinafter as a curve in the radial direction, the bevel along the leading edge being on the concave side.

The spin rate of the missile can be well controlled by adjustment of the angle of the bevel on the leading edge of the fins. However, the combination of this with sweep-back of the leading edge provides more effective control and thus greater accuracy.

The sweep-back angle can, of course, be larger than 45° but the fin surface becomes very small and it becomes a question of whether the spin rate control which is gained is worth the loss of missile stabilization.

Obviously, many modifications and variations of the present invention are possible in light of the above teachings. It is therefore to be understood that, within the scope of the appended claims, the invention may be practiced otherwise than as specifically described.

What is claimed is:

1. Means for improving the ballistic accuracy of a missile comprising:

a set of fins located around the body of a missile, said fins being curved in the radial direction of the missile and being formed with a bevel along the concave side of the leading edge of the fin, the leading edge of said fin also being formed with a sweep-back angle along the entire leading edge.

2. Means as set forth in claim 1, wherein the sweep-back angle is roughly 45°.

3. Means as in claim 1, wherein the bevel angle lies roughly in the 5° to 45° range.

4. Means as in claim 3, wherein the bevel angle is roughly 22°.

* * * * *